US008381660B2

(12) United States Patent
Kurahashi et al.

(10) Patent No.: US 8,381,660 B2
(45) **Date of Patent: *Feb. 26, 2013**

(54) TRACK-GUIDED VEHICLE WHEEL TRUCK

(75) Inventors: Hiroki Kurahashi, Mihara (JP); Nobuyuki Fujio, Mihara (JP); Hiroyuki Kono, Hiroshima (JP); Yukihide Yanobu, Hiroshima (JP); Akihisa Kawauchi, Hiroshima (JP); Kousuke Katahira, Kawasaki (JP)

(73) Assignee: Mitsubishi Heavy Industries Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/143,841

(22) PCT Filed: Jul. 1, 2009

(86) PCT No.: PCT/JP2009/062062

§ 371 (c)(1),
(2), (4) Date: Jul. 8, 2011

(87) PCT Pub. No.: WO2010/109683

PCT Pub. Date: Sep. 30, 2010

(65) Prior Publication Data

US 2011/0265683 A1 Nov. 3, 2011

(30) Foreign Application Priority Data

Mar. 25, 2009 (JP) ..... 2009-073954

(51) Int. Cl.
*B61F 1/00* (2006.01)

(52) U.S. Cl. ..... 105/215.2; 104/247

(58) Field of Classification Search ..... 105/72.2, 105/215.1, 215.2; 410/67; 104/243–249
See application file for complete search history.

(56) References Cited

U.S. PATENT DOCUMENTS 3,077,165 A 2/1963 Vittorelli
3,921,466 A * 11/1975 Allsup, Jr. ..... 74/110
(Continued)

FOREIGN PATENT DOCUMENTS

JP 48-086214 A 11/1973
JP 50150004 U1 12/1975
(Continued)

OTHER PUBLICATIONS

International Search Report from PCT/JP2009/062062 mailed Sep. 1, 2009.

(Continued)

*Primary Examiner* — Jason C Smith
(74) *Attorney, Agent, or Firm* — Lowe Hauptman Ham & Berner, LLP

(57) ABSTRACT

A track-guided vehicle wheel truck prevents wear and deterioration of a guide wheel and a guide rail, and ensures running stability while simplifying the structure. In the track-guided vehicle wheel truck, a guide frame 8 to which a guide wheel 9 guided by a guide rail 1 is mounted, can turn relative to a steering axle 6 of a running wheel 5. A support shaft 21 is provided on an axle bracket 20 provided in the steering axle 6 so as to be movable in the vehicle front and rear direction by straddling the steering axle 6. A link lever 22 capable of interlocking the turning of the guide frame 8 and the steering of the running wheel 5 is provided along the vehicle front and rear direction. A vehicle end-side end part of the link lever 22 is rotatably mounted to a connecting rod 19 that enables the steering of the running wheel 5. An intermediate part of the link lever 22 is rotatably mounted to the guide frame 8. A long hole 22*a* extending in the vehicle front and rear direction is provided in a center-side end part of the link lever 22. The long hole 22*a* and the support shaft 10 are rotatably engaged with each other at a given position.

4 Claims, 8 Drawing Sheets

U.S. PATENT DOCUMENTS

| | | | | |
|---|---|---|---|---|
| 4,089,272 | A * | 5/1978 | Schmitz | 104/247 |
| 4,105,086 | A * | 8/1978 | Ishii et al. | 180/410 |
| 4,183,304 | A * | 1/1980 | Forster | 104/247 |
| 4,223,611 | A * | 9/1980 | Dawson et al. | 104/247 |
| 4,265,180 | A * | 5/1981 | Uozumi | 104/247 |
| 4,274,338 | A * | 6/1981 | Uozumi | 105/144 |
| 4,299,172 | A * | 11/1981 | Dawson | 104/247 |
| 4,454,819 | A | 6/1984 | Cuylits et al. | |
| 6,029,579 | A | 2/2000 | Andre et al. | |
| 6,477,963 | B1 * | 11/2002 | Weule et al. | 104/243 |
| 8,074,577 | B2 * | 12/2011 | Morichika et al. | 104/139 |
| 8,161,889 | B2 | 4/2012 | Morichika et al. | |
| 2008/0083345 | A1 * | 4/2008 | Morita et al. | 104/106 |
| 2009/0259352 | A1 | 10/2009 | Morichika et al. | |
| 2009/0288575 | A1 | 11/2009 | Morichika et al. | |
| 2010/0036553 | A1 | 2/2010 | Morichika et al. | |
| 2010/0100267 | A1 | 4/2010 | Morichika et al. | |
| 2011/0265683 | A1 * | 11/2011 | Kurahashi et al. | 105/215.2 |
| 2011/0271868 | A1 | 11/2011 | Kurahashi et al. | |
| 2012/0017800 | A1 | 1/2012 | Kurahashi et al. | |
| 2012/0031298 | A1 | 2/2012 | Kurahashi et al. | |

FOREIGN PATENT DOCUMENTS

| | | | |
|---|---|---|---|
| JP | 51000608 | U1 | 1/1976 |
| JP | 53-030407 | B | 8/1978 |
| JP | 61006061 | A | 1/1986 |
| JP | 1-027492 | Y2 | 8/1989 |
| JP | 2006-306334 | A | 11/2006 |
| JP | 2008-068829 | A | 3/2008 |

OTHER PUBLICATIONS

Office Action corresponding to JP 2009-073954, dated Jan. 20, 2012.
Notice of Allowance for JP 2009-073954 mailed Apr. 13, 2012.
Notice of Allowance dated Sep. 20, 2012, for U.S. Appl. No. 13/260,427.

* cited by examiner

TRACK-GUIDED VEHICLE WHEEL TRUCK

RELATED APPLICATIONS

The present application is a National Phase of International Application Number PCT/JP2009/062062, filed Jul. 1, 2009, and claims priority from, Japanese Application Number 2009-073954, filed Mar. 25, 2009.

TECHNICAL FIELD

The present invention relates to a track-guided vehicle wheel truck (bogie) which runs along a track.

BACKGROUND ART

In general, a track-guided vehicle (hereinafter referred to as a "vehicle"), such as a subway car, or a new transportation system vehicle, runs along a track while being guided by a guide rail arranged along the track. In a wheel truck of a conventional vehicle, a running wheel of a rubber tire, or the like, is arranged facing in a fixed direction at all times relative to a guide wheel guided by the guide rail. Therefore, the direction of the running wheel is changed only by following the guide rail. However, when the vehicle moves into a curved guide rail, a large guide wheel working force directed toward the guide rail is applied to the guide wheel due to a force generated by the running wheel traveling straight or a centrifugal force acting on the vehicle. The guide wheel and the guide rail are thereby brought into contact with each other at a great pressure. As a result, there occurs a problem in that wear and deterioration are easily caused on the guide wheel and the guide rail.

To solve the problem, a cornering force on the running wheel opposing to the guide wheel working force, is increased, to thereby reduce the contact pressure of the guide wheel and the guide rail. As a method of increasing the cornering force, a steering mechanism for steering the running wheel is provided in the wheel truck of the vehicle, and the running wheel is steered by the steering mechanism so as to increase a slip angle (a steering angle) when the vehicle moves into the curved guide rail.

A wheel truck including such a steering mechanism is disclosed in Patent Document 1. In Patent Document 1, a pair of running wheels is connected to each other by an axle so as to be rotatable by a kingpin, and can be also interlocked with each other by a tie rod arranged along the vehicle width direction. Meanwhile, a guide wheel guided by a guide rail is mounted to a guide frame, and the guide frame can be turned around the center position between the pair of running wheels relative to the axle. Furthermore, a steering rod, for steerably connecting one of the pair of running wheels to the guide frame, is arranged along the vehicle width direction. One end part of the steering rod is mounted to a steering arm for steering one of the pair of running wheels, and the other end part of the steering rod is mounted to the guide frame so as to be movable in the vehicle front and rear direction. In addition, an actuator, which is extensible and retractable in the vehicle front and rear direction, is provided on the guide frame, and the end part on the guide frame side of the steering rod is mounted to the actuator. By the movement of the end part on the guide frame side of the steering rod along with the operation of the actuator, the distance between the end part and the turning center of the guide frame (or the axle) is changed relative to the distance between the end part on the running wheel side of the steering rod and the axle, so that the steering rod adopts a posture tilting relative to the axle. As a result, the displacement of the steering arm changes with the movement of the steering rod, and therefore, the slip angle of the running wheel steered by the steering arm is changed.

CITATION LIST

Patent Document

Patent Document 1: U.S. Pat. No. 6,477,963

SUMMARY OF INVENTION

Technical Problem

However, in the wheel truck in Patent Document 1, the posture of the steering rod arranged in the vehicle width direction is changed by the operation of the actuator in the vehicle front and rear direction, to thereby adjust the steering angle of the running wheel steered when the guide frame is turned. Therefore, the relationship among the operation of the actuator, the posture change of the steering rod, and the change in the steering angle of the running wheel is complicated, so that the structure and control thereof is also complicated. Therefore, it is difficult to control the operation of the actuator so as to slightly change the steering angle of the running wheel. For example, it is difficult to finely adjust the steering angle of the running wheel in response to a disturbance such as crosswind in order to allow the vehicle to stably run during straight running.

Furthermore, in the wheel truck in Patent Document 1, a fail-safe function assuming the breakdown of the actuator is not provided. Therefore, if the actuator is broken with the running wheel tilting relative to the guide frame, the running wheel in a straight running state is misaligned. In this case, there occurs a problem that the running wheel runs in a side slip state.

The present invention has been made in view of the aforementioned circumstances, and it is an object of the invention to provide a track-guided vehicle wheel truck in which, while simplifying the structure, the wear and deterioration of a guide wheel and a guide rail is prevented, when an actuator is used, the slip angle of a running wheel can be finely adjusted and the occurrence of trouble in association with the breakdown of the actuator can be prevented with the actuator being simply controlled, and furthermore, the running stability is ensured.

Solution to Problem

To achieve the above object, a track-guided vehicle according to the present invention includes: a pair of running wheels respectively connected to both ends of a steering axle by a kingpin; a guide wheel guided along a guide which is provided on a running track; and a guide frame to which the guide wheel is mounted, wherein the guide frame can turn relative to the steering axle. Such a track-guided vehicle comprises: a tie rod being arranged along a vehicle width direction on a center side of a vehicle front and rear direction relative to the steering axle, and being capable of interlocking the pair of running wheels with each other; a connecting rod being arranged on a vehicle end side of the vehicle front and rear direction relative to the steering axle, and being capable of steering one of the pair of running wheels; a first steering arm arranged along the vehicle front and rear direction, and mounted to one of the kingpins of the pair of running wheels; a second steering arm arranged along the vehicle front and rear direction, and mounted to the other of the kingpins of the pair of running wheels; an axle bracket provided along the vehicle front and rear direction so as to straddle the steering axle in a center of the vehicle width direction of the steering axle; a support shaft provided on the axle bracket such that position thereof can be adjusted in the vehicle front and rear direction so as to straddle the steering axle relative to the axle bracket; and a link lever arranged along the vehicle front and rear direction; wherein both end parts of the tie rod are rotatably mounted respectively to center-side end parts of the first steering arm and the second steering arm; wherein both end parts of the connecting rod are rotatably mounted respectively to a vehicle end-side end part of the first steering arm and a vehicle end-side end part of the link lever; wherein an intermediate part of the link lever is rotatably mounted to the guide frame, a long hole is provided in a center-side end part of the link lever so as to extend in the vehicle front and rear direction; and wherein the long hole and the support shaft are rotatably engaged with each other at a given position.

Regarding the track-guided vehicle according to the present invention, a restoration mechanism capable of restoring the support shaft to an original position after moving the support shaft, is provided in the guide frame, and the support shaft is movable in the vehicle front and rear direction by an actuator provided in the steering axle.

Regarding the track-guided vehicle according to the present invention, the guide wheel is supported by a leaf spring provided in the guide frame, detecting means for detecting a displacement of the leaf spring is provided, and control means for controlling the actuator corresponding to the displacement of the leaf spring detected by the detecting means is provided.

Advantageous Effects of Invention

The following effects can be obtained according to the present invention. A track-guided vehicle wheel truck according to the present invention includes: a pair of running wheels respectively connected to both ends of a steering axle by a kingpin; a guide wheel guided along a guide which is provided on a running track; and a guide frame to which the guide wheel is mounted, wherein the guide frame can turn relative to the steering axle. Such a track-guided vehicle comprises: a tie rod being arranged along a vehicle width direction on a center side of a vehicle front and rear direction relative to the steering axle, and being capable of interlocking the pair of running wheels with each other; a connecting rod being arranged on a vehicle end side of the vehicle front and rear direction relative to the steering axle, and being capable of steering one of the pair of running wheels; a first steering arm arranged along the vehicle front and rear direction, and mounted to one of the kingpins of the pair of running wheels; a second steering arm arranged along the vehicle front and rear direction, and mounted to the other of the kingpins of the pair of running wheels; an axle bracket provided along the vehicle front and rear direction so as to straddle the steering axle in a center of the vehicle width direction of the steering axle; a support shaft provided on the axle bracket such that position thereof can be adjusted in the vehicle front and rear direction so as to straddle the steering axle relative to the axle bracket; and a link lever arranged along the vehicle front and rear direction; wherein both end parts of the tie rod are rotatably mounted respectively to center-side end parts of the first steering arm and the second steering arm; wherein both end parts of the connecting rod are rotatably mounted respectively to a vehicle end-side end part of the first steering arm and a vehicle end-side end part of the link lever, wherein an intermediate part of the link lever is rotatably mounted to the guide frame, wherein a long hole is provided in a center-side end part of the link lever so as to extend in the vehicle front and rear direction; and wherein the long hole and the support shaft are rotatably engaged with each other at a given position.

Therefore, the support shaft provided as the rotation center of the link lever, is movable in the vehicle front and rear direction so as to straddle the steering axle.

Here, in a case in which the rotation center of the link lever is positioned on the vehicle end side of the steering axle, when the guide wheel and the guide frame are turned along a curved guide rail, the intermediate part of the link lever is rotatably mounted to the guide frame, so that the link lever rotates around the support shaft in the center-side end part. The vehicle end-side end part of the link lever, rotates in a larger circle than the intermediate part of the link lever, corresponding to the ratio of the distance between the vehicle end-side end part of the link lever and the support shaft in the center-side end part to the distance between the intermediate part of the link lever and the support shaft in the center-side end part. At this time, the vehicle end-side end part of the link lever is moved largely in the same direction as the turning of the guide frame. The connecting rod is thereby moved, so that the first steering arm is also moved. As a result, one of the pair of running wheels is steered to assume a slip angle in an oversteered state which is larger than the turning angle of the guide frame. In addition, the tie rod is moved when one of the pair of running wheels is steered, so that the second steering arm is moved. As a result, the other of the pair of running wheels is steered to assume a slip angle in an oversteered state.

On the other hand, in a case in which the rotation center of the link lever is positioned on the center side of the steering axle, when the guide wheel and the guide frame are turned, the vehicle end-side end part of the link lever rotates in a larger circle than the intermediate part of the link lever, corresponding to the ratio of the distance between the vehicle end-side end part of the link lever and the support shaft in the center-side end part to the distance between the intermediate part of the link lever and the support shaft in the center-side end part. At this time, the vehicle end-side end part of the link lever is moved in the direction opposite to the turning of the guide frame. The connecting rod is thereby moved, so that the first steering arm is also moved. As a result, one of the pair of running wheels is steered to assume a slip angle in an understeered state which is smaller than the turning angle of the guide frame. In addition, when one of the pair of running wheels is steered, the tie rod is moved, so that the second steering arm is moved. As a result, the other of the pair of running wheels is steered to assume a slip angle in an understeered state.

The ratio of the distance between the vehicle end-side end part of the link lever and the support shaft in the center-side end part, to the distance between the intermediate part of the link lever and the support shaft in the center-side end part, can be changed by the movement of the support shaft. Therefore, the slip angle of the running wheel can be changed between the oversteered state and the understeered state. Accordingly, the slip angles of the pair of running wheels are appropriately adjusted to one of the oversteered state and the understeered state based on the curvature radius of the curved guide rail, the running speed of the vehicle, or the like, so that a cornering force on the pair of running wheels can be adjusted. As a result, a guide wheel, working force directed toward the guide rail from the guide wheel, can be decreased, and the contact pressure of the guide wheel and the guide rail, can be also decreased. For example, when the running wheel is a rubber tire, the distance between the vehicle end-side end part of the link lever and the support shaft in the center-side end part, is increased relative to the distance between the intermediate part of the link lever and the support shaft in the center-side end part in the oversteered state in response to the decrease in the cornering force due to the wear of the rubber tire. Accordingly, the slip angles of the pair of running wheels can be increased, and the contact pressure of the guide wheel and the guide rail can be adjusted so as to be effectively decreased. Therefore, while the structure of the track-guided vehicle wheel truck is simplified, the wear and deterioration of the guide wheel and the guide rail can be effectively prevented, and the running stability of the vehicle can be also ensured.

According to the track-guided vehicle according to the present invention, a restoration mechanism capable of restoring the support shaft to an original position after moving the support shaft, is provided in the guide frame, and the support shaft is movable in the vehicle front and rear direction by an actuator provided in the steering axle. Therefore, the relationship between the control of the ratio of the distance between the vehicle end-side end part of the link lever and the support shaft in the center-side end part to the distance between the intermediate part of the link lever and the support shaft in the center-side end part, which is practiced by the actuator, and the adjustment of the slip angles of the pair of running wheels, is simplified. Therefore, the control of the track-guided vehicle wheel truck can be simplified. Furthermore, even when the actuator is broken, the restoration mechanism can restore the support shaft to the original neutral position before being moved by the actuator. In addition, the operation of the actuator is separated from the turning of the guide frame and the steering of the running wheel. Therefore, even when the actuator is broken, the pair of running wheels is normally steered corresponding to straight running and curve running, so that the vehicle can normally run. Accordingly, the occurrence of trouble in association with the breakdown of the actuator can be prevented, and the vehicle running stability can be also ensured.

According to the track-guided vehicle according to the present invention, the guide wheel is supported by a leaf spring provided in the guide frame, detecting means for detecting a displacement of the leaf spring is provided, and control means for controlling the actuator corresponding to the displacement of the leaf spring detected by the detecting means is provided. Therefore, even when a disturbance such as an impact is applied to the guide wheel from the guide rail, the disturbance transmitted to the guide frame is mitigated by the leaf spring, so that the vehicle running stability can be ensured. Furthermore, the vehicle gives passengers a more comfortable ride. In addition, the steering amount of the pair of running wheels can be quickly controlled by the actuator corresponding to the displacement of the guide wheel relative to the guide frame detected by the detecting means. Therefore, when the vehicle runs on the curved guide rail, the slip angles of the pair of running wheels can be quickly and appropriately adjusted. The vehicle running stability can be thereby ensured.

DESCRIPTION OF EMBODIMENTS

In the following, wheel trucks used for a track-guided vehicle (hereinafter referred to as a "vehicle") according to first to third embodiments of the present invention, will be described. The first to third embodiments of the present invention will be described by employing, as one example of the vehicle, a vehicle provided with wheel trucks on the front side and the rear side thereof, and the description will be made taking the vehicle travel direction as the vehicle front.

First Embodiment

Figure 1:
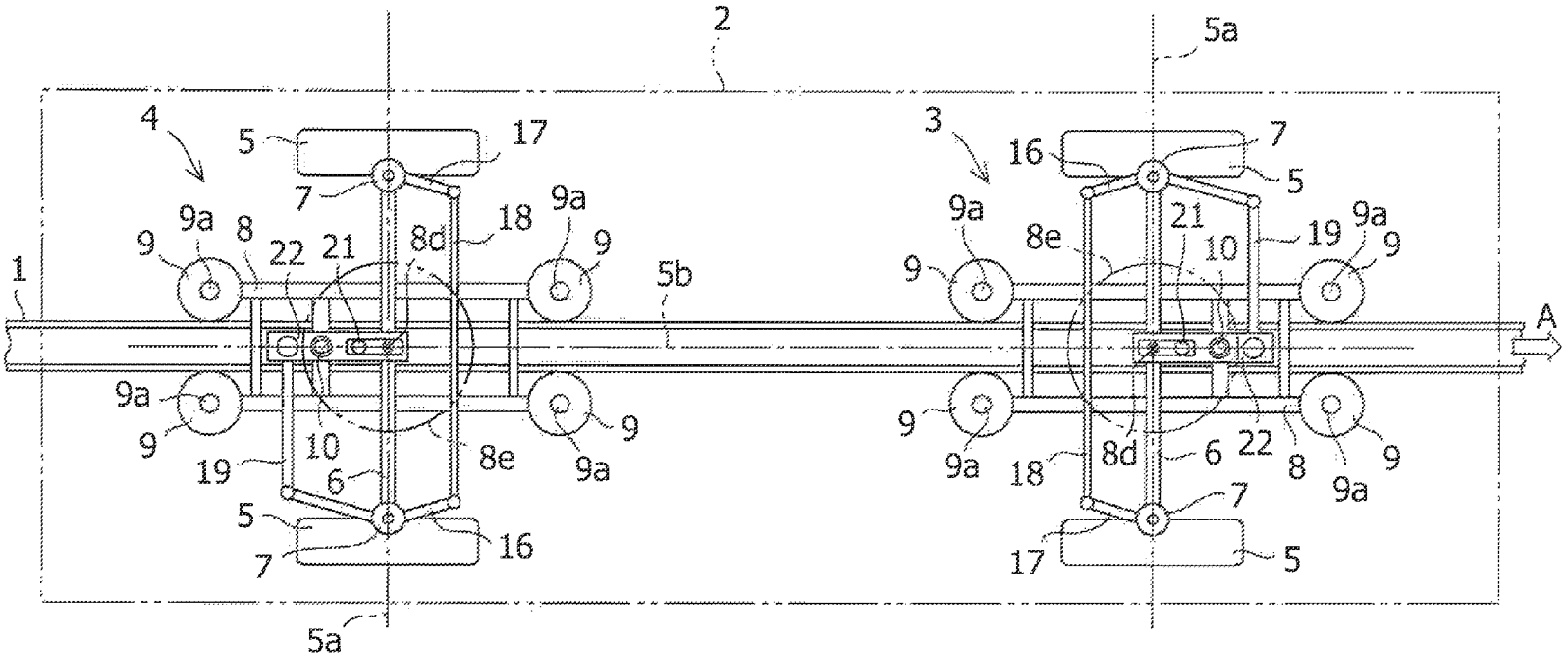
FIG. 1 is an explanatory view schematically illustrating a track-guided vehicle which is running straight according to a first embodiment of the present invention.

A vehicle wheel truck according to the first embodiment of the present invention will be described below. Referring to FIG. 1, in a vehicle traveling in the direction indicated by the arrow A, a pair of right and left center guides 1 in the vehicle width direction are arranged along a track path of the vehicle in the middle of the vehicle width direction of the vehicle. The vehicle runs while being guided along the center guide 1. In the vehicle as described above, a front wheel truck 3 and a rear wheel truck 4 are respectively arranged on the front side and the rear side of the vehicle under a vehicle body 2.

The structures of the front wheel truck 3 on the front side and the rear wheel truck 4 on the rear side (hereinafter referred to as "wheel trucks 3 and 4") will now be described by reference to FIGS. 1 to 3. In the wheel trucks 3 and 4, a pair of running wheels 5 is provided. As one example of the running wheel 5, a rubber tire is used mainly in a vehicle such as a subway car and a new transportation system vehicle. As another example of the running wheel 5, a wheel made of any other material, such as a steel wheel, may be used. The aforementioned pair of running wheels 5 can rotate around an identical axis 5*a*, and are arranged at an interval in the vehicle width direction. Furthermore, in the wheel trucks 3 and 4, a steering axle 6 is arranged along the axis 5*a* of the running wheel 5. The pair of running wheels 5 is respectively mounted to both end parts of the steering axle 6 by kingpins 7, and thereby connected to each other. On the other hand, a guide frame 8 is arranged below the steering axle 6 so as to extend in the vehicle front and rear direction relative to the steering axle 6.

Figure 2:
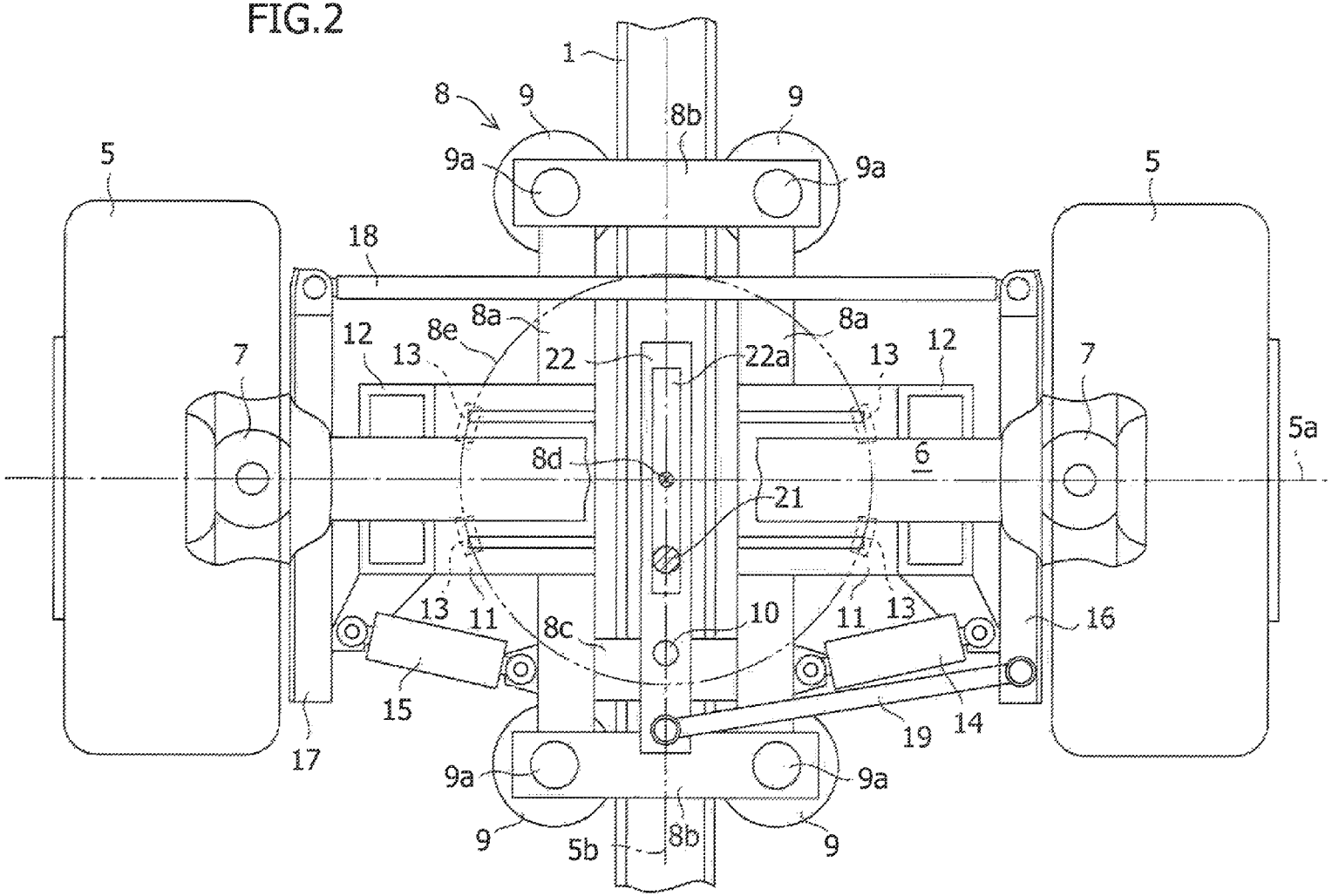
FIG. 2 is a plan view schematically illustrating a track-guided vehicle wheel truck according to the first embodiment of the present invention.
Figure 3:
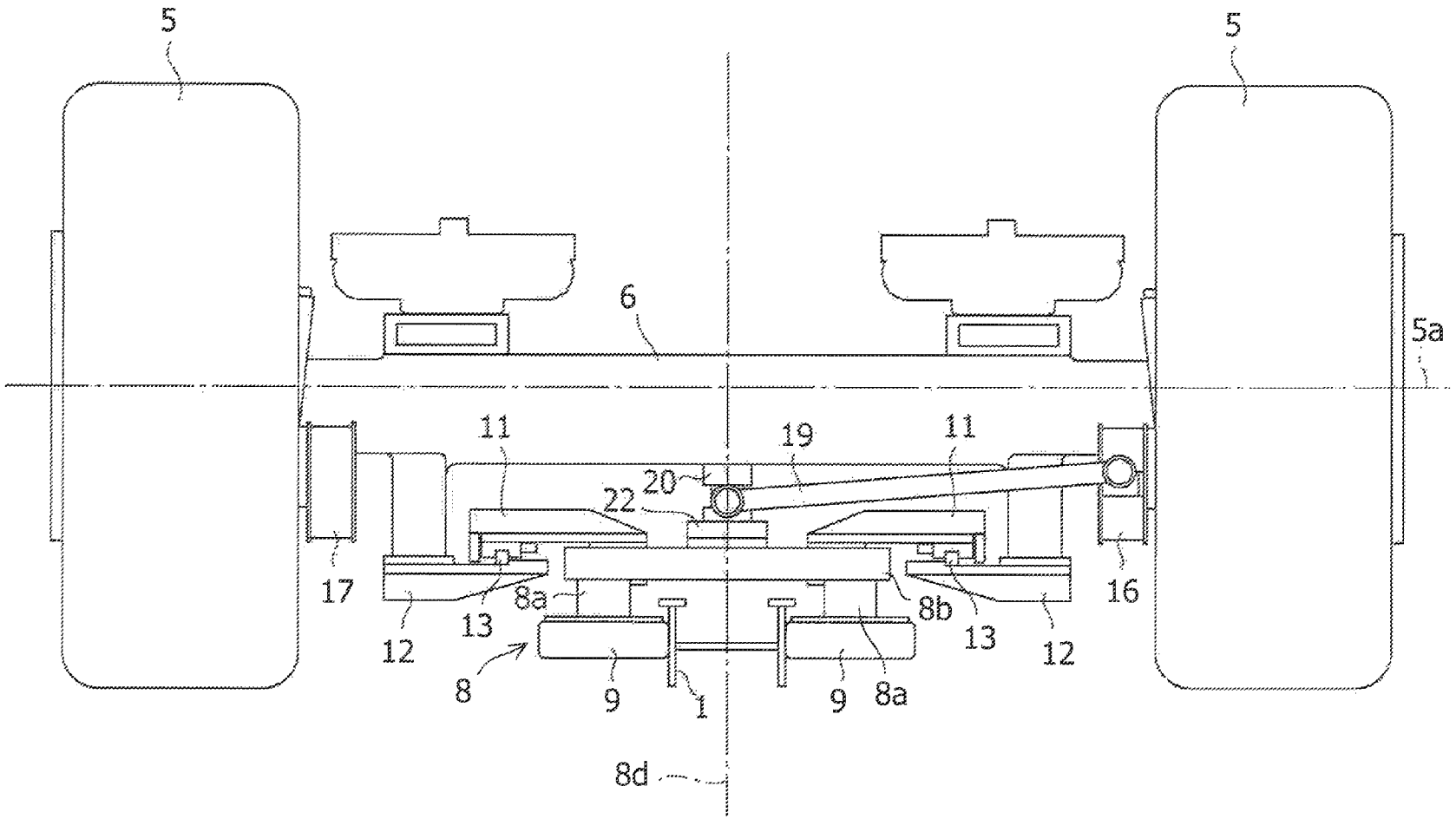
FIG. 3 is a front view schematically illustrating the track-guided vehicle wheel truck, according to the first embodiment of the present invention.

Here, referring to FIGS. 2 and 3, in the guide frame 8, a pair of longitudinal beams 8*a* is arranged at an interval in the vehicle width direction so as to extend in the vehicle front and rear direction. Lateral beams 8*b* are father arranged so as to respectively extend between the pair of longitudinal beams 8*a* at both end parts of the vehicle front and rear direction thereof. Guide wheels 9 are mounted to the both end parts of the longitudinal beam 8*a* so as to be rotatable around a rotation shaft 9*a*. Therefore, the paired guide wheels 9 are positioned on each of the vehicle end side and the center side of the vehicle front and rear direction relative to the steering axle 6. The center guide 1 passes between the pair of guide wheels 9. The guide wheel 9 rolls along the outer surface of the vehicle width direction of the center guide 1, and is thereby guided by the center guide 1.

In the guide frame 8, a support beam 8*c* is arranged at a position between the steering axle 6 and the lateral beam 8*b* on the vehicle end side so as to extend between the pair of longitudinal beams 8*a*. A mounting shaft 10 is provided on the support beam 8*c* so as to project upward. The mounting shaft 10 is arranged on a center axis 5*b* that extends in the vehicle front and rear direction in the center of the pair of running wheels 5.

In the guide frame 8, a first turn member 11 is arranged along the steering axle 6 so as to extend outward in the vehicle width direction from each of the pair of longitudinal beams 8*a*. A second turn member 12 is arranged below the first turn member 11 so as to extend in the vehicle width direction. A linear guide 13 is provided between the first turn member 11 and the second turn member 12. The linear guide 13 is arranged on a virtual circle 8*e* having a given radius from a turning center shaft 8*d* which extends vertically in the center of the pair of running wheels 5. The turning center shaft 8*d* corresponds to the intersection between the axis 5*a* of the running wheel 5 and the center axis 5*b* extending in the vehicle front and rear direction in the center of the pair of running wheels 5. The linear guide 13 allows the first turn member 11 to be turned around the turning center shaft 8*d* relative to the second turn member 12. Furthermore, the second turn member 12 is mounted to the steering axle 6. Therefore, the guide frame 8 can be turned around the turning center shaft 8*d* relative to the steering axle 6.

As shown in FIG. 2, in the wheel trucks 3 and 4, a restoration rod 14 and a horizontal damper 15 are provided. In FIG. 3, the restoration rod 14 and the horizontal damper 15 are omitted. The restoration rod 14 is arranged on the vehicle end side relative to the steering axle 6 and on one side of the pair of running wheels 5 relative to the center axis 5*b*. One end part of the restoration rod 14 is rotatably mounted to the longitudinal beam 8*a* of the guide frame 8, and the other end part of the restoration rod 14 is rotatably mounted to the second turn member 12. On the other hand, the horizontal damper 15 is arranged on the vehicle end side relative to the steering axle 6 and on the other side of the pair of running wheels 5 relative to the center axis 5*b*. One end part of the horizontal damper 15 is rotatably mounted to the longitudinal beam 8*a* of the guide frame 8, and the other end part of the horizontal damper 15 is rotatably mounted to the second turn member 12. Accordingly, the restoration rod 14 and the horizontal damper 15 can restore the guide frame 8 to an original neutral position after being turned, and further buffer the turning of the guide frame 8.

Here, referring to FIGS. 1 and 2 again, a first aiming arm 16 for enabling steering of one of the pair of running wheels 5, is arranged along the vehicle front and rear direction, and is also mounted to one of the kingpins 7 of the pair of running wheels 5. A second steering arm 17 for enabling steering of the other of the pair of running wheels 5, is arranged along the vehicle front and rear direction, and is also mounted to the other of the kingpins 7 of the pair of running wheels 5. A tie rod 18 for interlocking the pair of running wheels 5 with each other is arranged along the vehicle width direction on the center side of the steering axle 6. Both end parts of the tie rod 18 are rotatably mounted respectively to center-side end parts of the first steering aim 16 and the second steering aim 17. Furthermore, a connecting rod 19 for steering one of the pair of running wheels 5 is arranged along the vehicle width direction on the vehicle end side of the steering axle 6.

In a center part of the vehicle width direction of the steering axle 6, an axle bracket 20 is mounted so as to be arranged along the vehicle front and rear direction by straddling the steering axle 6. A support shaft 21 is provided on the axle bracket 20 so as to project upward of the vehicle. The support shaft 21 is provided such that position thereof can be adjusted in the vehicle front and rear direction so as to straddle the steering axle 6. In the wheel trucks 3 and 4, a link lever 22 is arranged along the center axis 5*b* so as to straddle the steering axle 6.

A vehicle end-side end part of the first steering lever 16 is rotatably mounted to one end part of the connecting rod 19. A vehicle end-side end part of the link lever 22 is rotatably mounted to the other end part of the connecting rod 19. An intermediate part of the link lever 22 is rotatably mounted to the mounting shaft 10 which is provided on the guide frame 8. A long hole 22*a* is provided in a center-side end part of the link lever 22 so as to extend in the vehicle front and rear direction by straddling the steering axle 6. The long hole 22*a* and the support shaft 21 which are provided on the axle bracket 20, are rotatably engaged with each other at a given position. The engagement position of the support shaft 21 and the long hole 22*a* can be thereby changed in the vehicle front and rear direction so as to straddle the steering axle 6.

Figure 4:
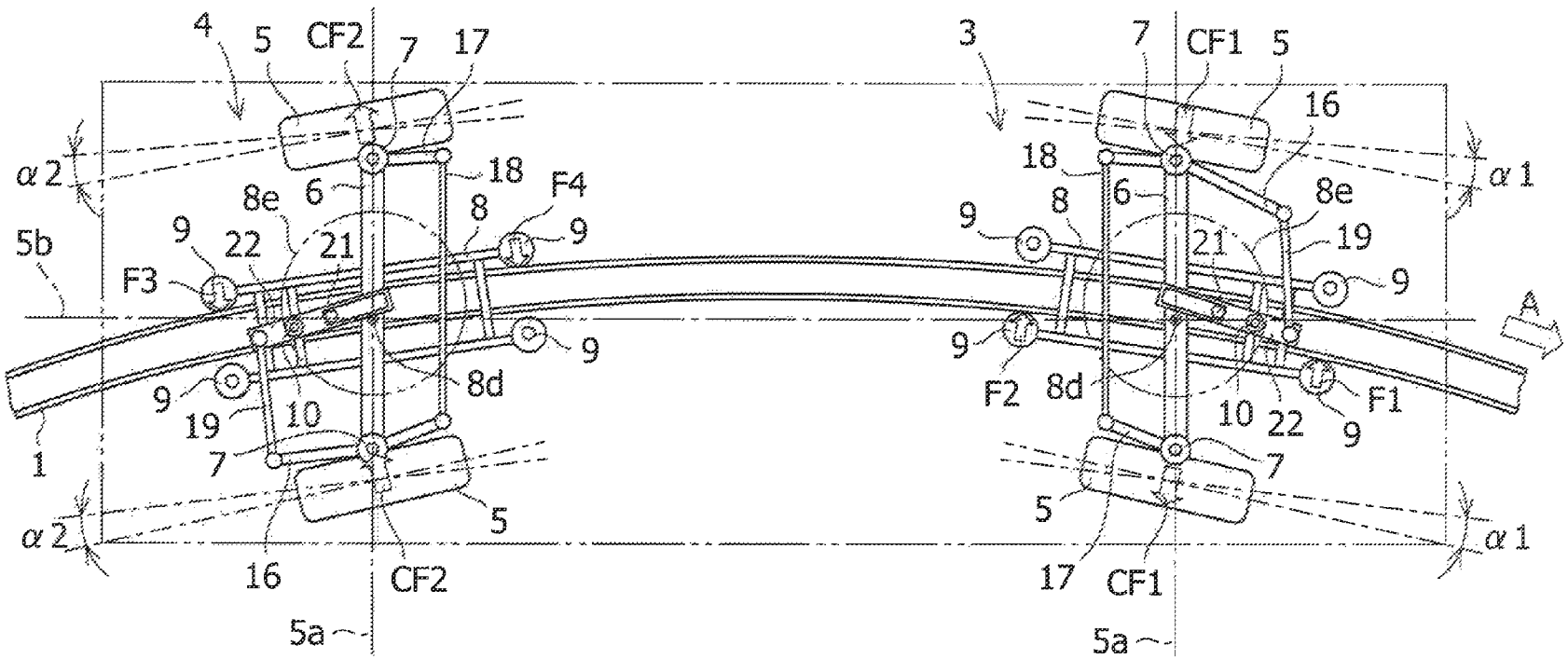
FIG. 4 is an explanatory view schematically illustrating a track-guided vehicle that is running on a curve according to the first embodiment of the present invention.
Figure 5B:
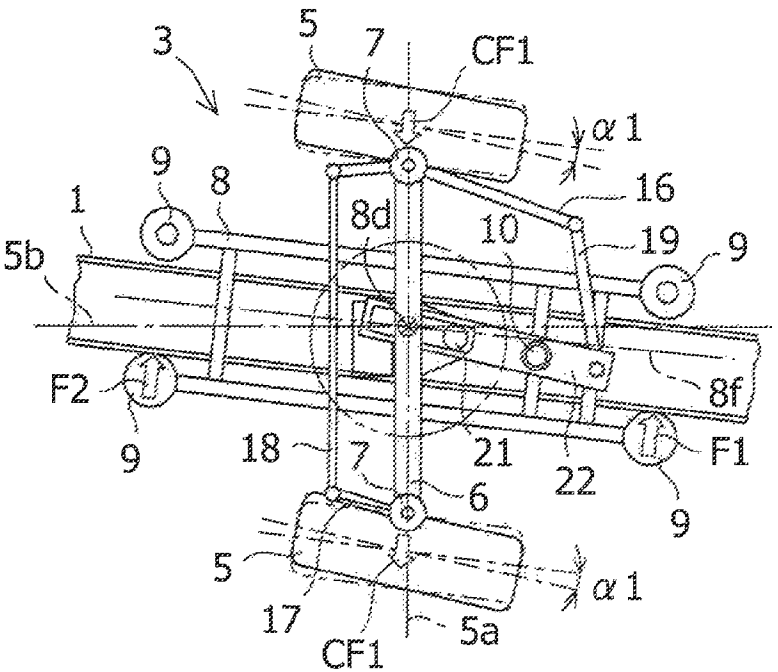
FIG. 5(*a*) is an explanatory view schematically illustrating a track-guided vehicle wheel truck on the vehicle front side in an oversteered state, and FIG. 5(*b*) is an enlarged view of the track-guided vehicle wheel truck on the vehicle front side in the oversteered state.
Figure 5A:
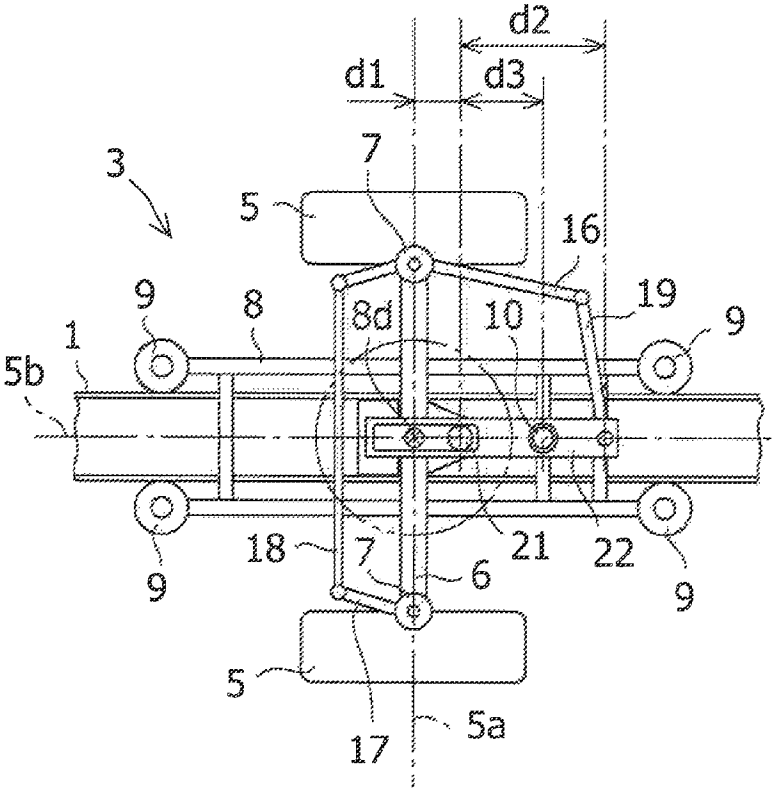

A change in the slip angle of the running wheel 5 in association with the change in the engagement position of the support shaft 21 and the long hole 22*a*, will now be described by reference to FIGS. 4, 5(*a*), 5(*b*), 6(*a*), and 6(*b*).

A case in which the engagement position of the support shaft 21 and the long hole 22*a*, is on the vehicle end side relative to the steering axle 6 will be described by reference to FIGS. 4, 5(*a*), and 5(*b*). In a case in which the support shaft 21 provided as the rotation center of the link lever 22 is positioned on the vehicle end side apart from the steering axle 6 by a distance d1 (shown in FIG. 5(*a*)), when the guide wheel 9 and the guide frame 8 are turned along the curved center guide 1, the intermediate part of the link lever 22 is rotatably mounted to the guide frame 8, so that the link lever 22 rotates around the support shaft 21 in the center-side end part. The vehicle end-side end part of the link lever 22 rotates in a larger circle than the intermediate part of the link lever 22, corresponding to the ratio of a distance d2 (shown in FIG. 5(*a*)) between the vehicle end-side end part of the link lever 22 and the support shaft 21 in the center-side end part, to a distance d3 (shown in FIG. 5(*a*)) between the intermediate part of the link lever 22 and the support shaft 21 in the center-side end part. At this time, the vehicle end-side end part of the link lever 22 is moved greatly in the same direction as the turning of the guide frame 8 relative to an axis passing through the middle of the vehicle width direction of the guide frame 8. The connecting rod 19 is thereby moved, so that the first steering arm 16 is also moved. As a result, a slip angle $\alpha 1$ tilting to the curve inside relative to the tangential direction of the curve, is generated in one of the pair of running wheels 5 in the front wheel truck 3, and a slip angle $\alpha 2$ tilting to the curve outside relative to the tangential direction of the curve, is generated in one of the pair of running wheels 5 in the rear wheel truck 4. When one of the pair of running wheels 5 is steered, the tie rod 18 is moved, so that the second steering arm 17 is also moved. As a result, a slip angle α1 tilting to the curve inside relative to the tangential direction of the curve is generated in the other of the pair of running wheels 5 in the front wheel truck 3, and a slip angle α2 tilting to the curve outside relative to the tangential direction of the curve is generated in the other of the pair of running wheels 5 in the rear wheel truck 4. Therefore, the wheel trucks 3 and 4 are brought into an oversteered state. The aforementioned mode is employed when the vehicle runs at a speed slightly faster than its equilibrium speed on a cant curve and in a state in which there is an insufficient cant.

At this time, in the front wheel truck 3, a cornering force (indicated by the arrow CF1) directed toward the inside of the curve is generated on the pair of running wheels 5, so that on the curve inside, a guide wheel working force (indicated by the arrow F1) directed toward the outside of the curve from the guide wheel 9 on the vehicle end side can be decreased and a guide wheel working force (indicated by the arrow F2) directed toward the outside of the curve from the guide wheel 9 on the center side can be decreased. Accordingly, the contact pressure of the center guide 1 and the guide wheels 9 on the curve inside can be decreased. On the other hand, in the rear wheel truck 4, a cornering force (indicated by the arrow CF2) directed toward the outside of the curve is generated on the pair of running wheels 5, so that on the curve outside, a guide wheel working force (indicated by the arrow F3) directed toward the inside of the curve from the guide wheel 9 on the vehicle end side, can be decreased, and a guide wheel working force (indicated by the arrow F4) directed toward the inside of the curve from the guide wheel 9 on the center side, can be decreased. Accordingly, the contact pressure of the center guide 1 and the guide wheels 9 on the curve outside can be decreased.

Figure 6B:
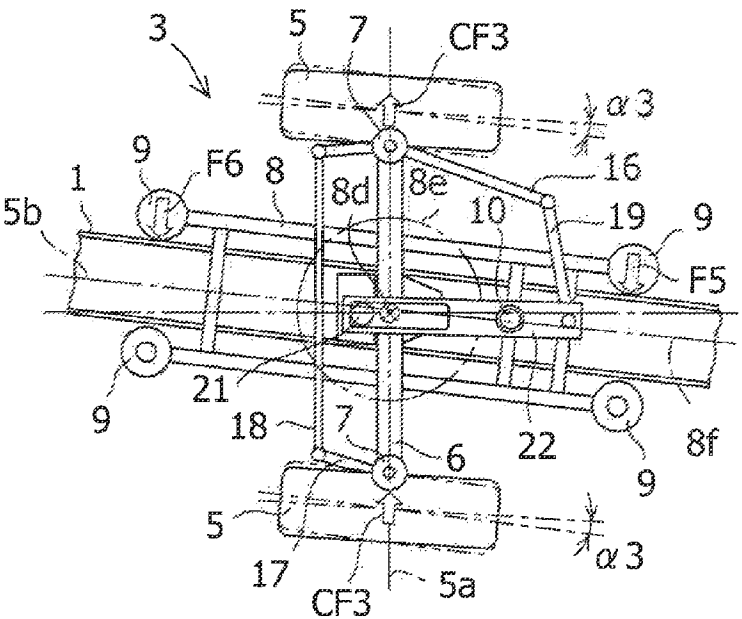
FIG. 6(*a*) is an explanatory view schematically illustrating a track-guided vehicle wheel truck on the vehicle front side in an understeered state, and FIG. 6(*b*) is an enlarged view of the track-guided vehicle wheel truck on the vehicle front side in the understeered state.
Figure 6A:
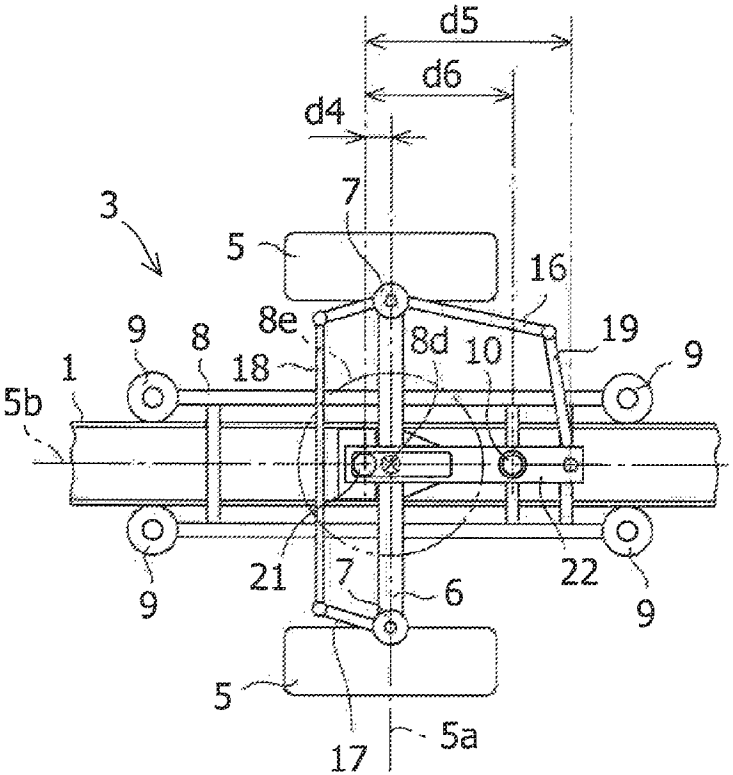

On the other hand, a case in which the engagement position of the support shaft 21 and the long hole 22*a* is on the vehicle center side relative to the steering axle 6, will be described by reference to FIGS. 6(*a*) and 6(*b*). In a case in which the support shaft 21 provided as the rotation center of the link lever 22 is positioned on the center side apart from the steering axle 6 by a distance d4 (shown in FIG. 6(*a*)), when the guide wheel 9 and the guide frame 8 are turned along the curved center guide 1, the intermediate part of the link lever 22 is rotatably mounted to the guide frame 8, so that the link lever 22 rotates around the support shall 21 in the center-side end part. At this time, the vehicle end-side end part of the link lever 22 rotates in a larger circle than the intermediate part of the link lever 22, corresponding to the ratio of a distance d5 (shown in FIG. 6(*a*)) between the vehicle end-side end part of the link lever 22 and the support shaft 21 in the center-side end part, to a distance d6 (shown in FIG. 6(*a*)) between the intermediate part of the link lever 22 and the support shaft 21 in the center-side end part. At this time, the vehicle end-side end part of the link lever 22 is moved in the direction opposite to the turning of the guide frame 8 relative to the axis 8*f* passing through the middle of the vehicle width direction of the guide frame 8. The connecting rod 19 is thereby moved, so that the first steering arm 16 is also moved. As a result, a slip angle α3 tilting to the curve outside relative to the tangential direction of the curve, is generated in one of the pair of running wheels 5 in the front wheel truck 3, and a slip angle α4 (not shown) tilting to the curve inside relative to the tangential direction of the curve, is generated in one of the pair of running wheels 5 in the rear wheel truck 4. When one of the pair of running wheels 5 is steered, the tie rod 18 is moved, so that the second steering arm 17 is also moved. As a result, a slip angle α3 tilting to the curve outside relative to the tangential direction of the curve, is generated in the other of the pair of running wheels 5 in the front wheel truck 3, and a slip angle α4 (not shown) tilting to the curve inside relative to the tangential direction of the curve, is generated in the other of the pair of running wheels 5 in the rear wheel truck 4. Therefore, the wheel trucks 3 and 4 are brought into an understeered state. The aforementioned mode is employed when the vehicle runs at a speed slightly slower than its equilibrium speed on a cant curve and in a state in which there is an excessive cant.

At this time, in the front wheel truck 3, a cornering force (indicated by the arrow CF3) directed toward the outside of the curve is generated on the pair of running wheels 5, so that on the curve outside, a guide wheel working force (indicated by the arrow F5) directed toward the inside of the curve from the guide wheel 9 on the vehicle end side, can be decreased and a guide wheel working force (indicated by the arrow F6) directed toward the inside of the curve from the guide wheel 9 on the center side, can be decreased. Accordingly, the contact pressure of the center guide 1 and the guide wheels 9 on the curve outside can be decreased. On the other hand, although not shown in the drawings, in the rear wheel truck 4, a cornering force directed toward the inside of the curve is generated on the pair of running wheels 5, so that on the curve inside, a guide wheel working force directed toward the outside of the curve from the guide wheel 9 on the vehicle end side, can be decreased, and a guide wheel working force directed toward the outside of the curve from the guide wheel 9 on the center side, can be decreased. Accordingly, the contact pressure of the center guide 1 and the guide wheels 9 on the curve outside can be decreased.

As described above, according to the first embodiment of the present invention, the slip angles of the pair of running wheels 5 are appropriately adjusted to one of the oversteered state and the understeered state based on the curvature radius of the curved center guide 1, the running speed of the vehicle, or the like, so that the cornering force on the pair of running wheels 5, can be adjusted. As a result, the guide wheel working force directed toward the center guide 1 from the guide wheels 9 can be decreased, and the contact pressure of the center guide 1 and the guide wheels 9, can be also decreased. For example, when the running wheel 5 is a rubber tire, the distance between the vehicle end-side end part of the link lever 22 and the support shaft 21 in the center-side end part, is increased relative to the distance between the intermediate part of the link lever 22 and the support shaft 21 in the center-side end part in the oversteered state in response to the decrease in the cornering force due to the wear of the rubber tire. Accordingly, the slip angles of the pair of running wheels 5 can be increased, and the contact pressure of the center guide 1 and the guide wheels 9 can be adjusted so as to be effectively decreased.

As described above, while the structures of the wheel trucks 3 and 4 are simplified, the wear and deterioration of the guide wheels and the center guide can be effectively prevented, and the running stability of the vehicle can be also ensured.

Second Embodiment

Vehicle wheel trucks according to the second embodiment of the present invention will be described below. The basic features of the vehicle in the second embodiment are the same as those of the vehicle in the first embodiment. The description is given applying the same symbols and names as those in the first embodiment to elements that are essentially the same as those in the first embodiment. Features different from those in the first embodiment will be described below.

Figure 7:
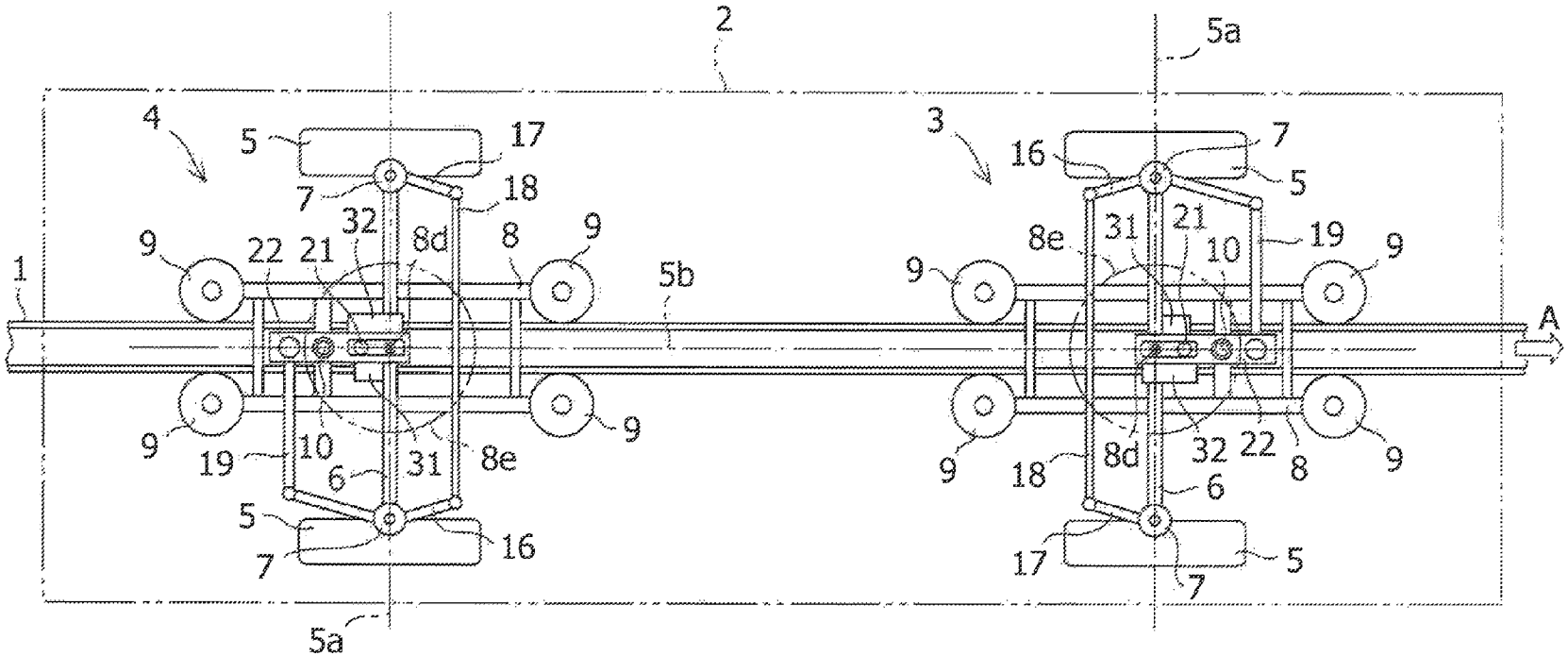
FIG. 7 is an explanatory view schematically illustrating a track-guided vehicle which is running straight according to a second embodiment of the present invention.

As shown in FIG. 7, a restoration mechanism 31 is arranged along the vehicle front and rear direction in the guide frame 8. The restoration mechanism 31 is provided so as to restore the support shaft 21 to an original neutral position in a straight running state when the support shaft 21 is moved during curve running or the like. As one example of the restoration mechanism 31, a coil spring may be used. Any urging means other than the coil spring may be also used. Furthermore, in the guide frame 8, an actuator 32 which is extensible and retractable in the vehicle front and rear direction, is arranged along the vehicle front and rear direction. The actuator 32 can move the support shaft 21 in the vehicle front and rear direction. Accordingly, the position of the support shaft 21 in the vehicle front and rear direction can be adjusted by the operation of the actuator 32.

As described above, according to the second embodiment of the present invention, the relationship between the control of the ratio of the distance between the vehicle end-side end part of the link lever 22 and the support shaft 21 in the center-side end part to the distance between the intermediate part of the link lever 22 and the support shaft 21 in the center-side end part by the actuator 32, and the adjustment of the slip angles of the pair of running wheels 5, is simplified. Therefore, the control of the wheel trucks 3 and 4 can be simplified. Furthermore, even when the actuator 32 is broken, the restoration mechanism 31 can restore the support shaft 21 to the original neutral position before being moved by the actuator 32. In addition, the operation of the actuator 32 is separated from the turning of the guide frame 8 and the steering of the running wheel 5. Therefore, even when the actuator 32 is broken, the pair of running wheels 5 is normally steered corresponding to straight running and curve running, so that the vehicle can normally run. Accordingly, the occurrence of trouble in association with the breakdown of the actuator 32 can be prevented, and the vehicle running stability can be thereby ensured.

Third Embodiment

Vehicle wheel trucks according to the third embodiment of the present invention will be described below. The basic features of the vehicle in the third embodiment are the same as those of the vehicle in the second embodiment. The description is given applying the same symbols and names as those in the third embodiment to elements that are essentially the same as those in the second embodiment. Features different from those in the second embodiment will be described below.

Figure 8:
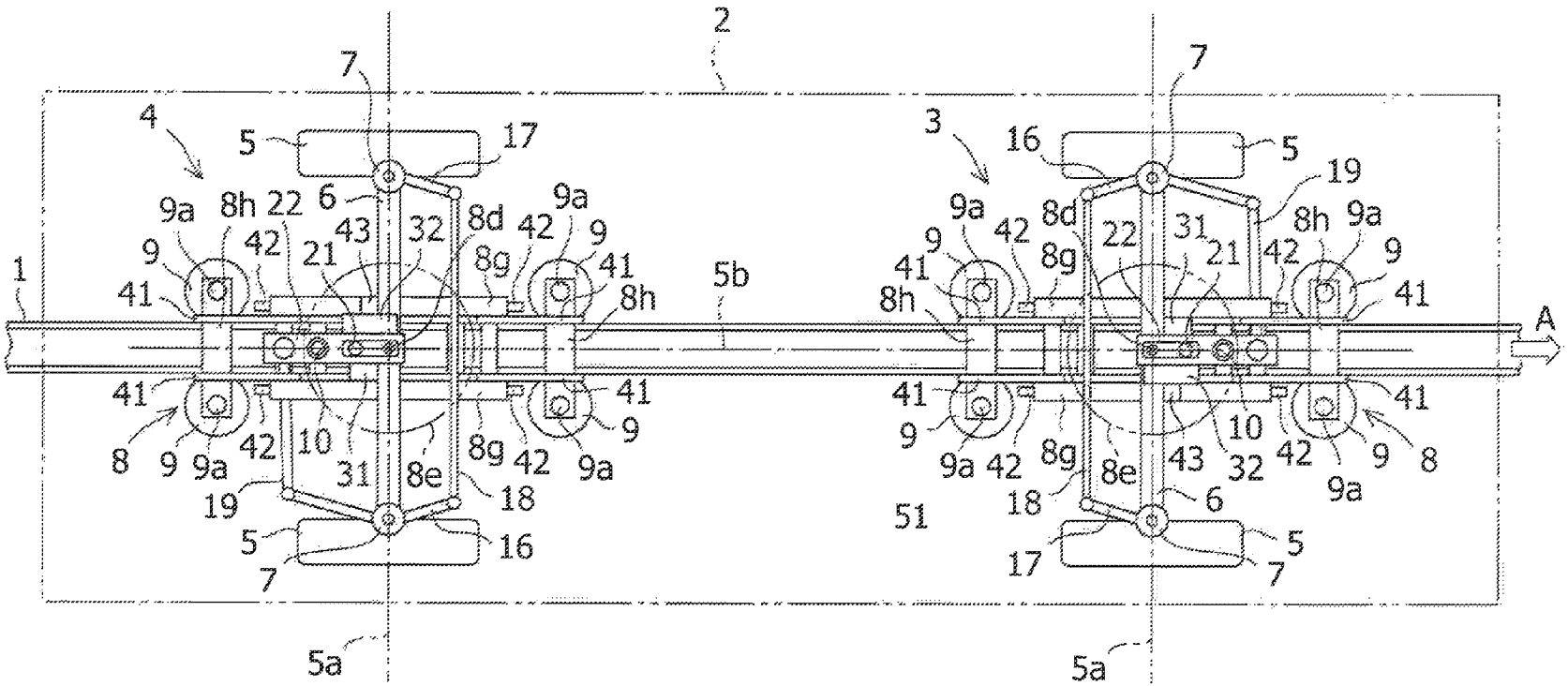
FIG. 8 is an explanatory view schematically illustrating a track-guided vehicle which is running straight according to a third embodiment of the present invention.

As shown in FIG. 8, in the guide frame 8, a pair of longitudinal beams 8*g* is arranged at an interval in the vehicle width direction so as to extend in the vehicle front and rear direction. Lateral beams 8*h* are arranged so as to respectively extend in the vehicle width direction at both end parts of the vehicle front and rear direction of the guide frame 8. The guide wheels 9 are mounted to both end parts of the lateral beam 8*h* so as to be rotatable around the rotation shaft 9*a*. Leaf springs 41 are arranged between the longitudinal beams 8*g* and the lateral beams 8*h* at the both end parts of the vehicle front and rear direction. Therefore, the paired guide wheels 9 and the paired leaf springs 41 are positioned on each of the vehicle end side and the center side of the vehicle front and rear direction relative to the steering axle 6. The center guide 1 passes between the pair of guide wheels 9. The guide wheel 9 rolls on the outer surface of the vehicle width direction of the center guide 1, and is thereby guided by the center guide 1.

Detecting means 42, capable of detecting the displacement of the leaf spring 41, is provided in the guide frame 8 corresponding to the leaf spring 41. As one example of the detecting means 42, a limit switch may be employed. Another detecting means may be also employed as long as the means can detect the displacement of the leaf spring 41. Control means 43 for controlling the actuator 32 corresponding to the displacement of the leaf spring 41 which is detected by the detecting means 42, is also provided.

As described above, according to the third embodiment of the present invention, even when a disturbance such as an impact is applied to the guide wheel 9 from the center guide 1, the disturbance transmitted to the guide frame 8 is mitigated by the leaf spring 41, so that the vehicle running stability can be ensured. Furthermore, the vehicle gives a passenger a more comfortable ride. Furthermore, the steering amount of the pair of running wheels 5 can be quickly controlled by the actuator 32 corresponding to the displacement of the guide wheel 9 relative to the guide frame 8 detected by the detecting means 42. Therefore, when the vehicle runs on the curved center guide 1, the slip angles of the pair of running wheels 5 can be quickly and appropriately adjusted. The vehicle running stability can be thereby ensured.

The embodiments of the present invention have been described above. It should be noted that the present invention is not limited to the above described embodiments, and various modifications and changes may be made therein based on the technical concepts of the present invention.

For example, as a first modification of the embodiment, in the first to third embodiments, the guide wheels 9 may be guided by rolling on the inner surfaces of the vehicle width direction of a pair of right and left guide rails in the vehicle width direction, which is of center guide type. The same effects as those in the first to third embodiments can be thereby obtained.

As a second modification of the embodiment of the present invention, in the first to third embodiments, the guide wheels 9 may be guided by a pair of right and left side guides arranged on the outer side of the vehicle width direction of the vehicle. The same effects as those in the first to third embodiments can be thereby obtained.

REFERENCE SYMBOLS LIST

1 Center guide
2 Vehicle body
3 Front wheel truck
4 Rear wheel truck
5 Running wheel
5*a* Axis
5*b* Center axis
6 Steering axle
7 Kingpin
8 Guide frame
8*a*, 8*g* Longitudinal beam
8*b*, 8*h* Lateral beam
8*c* Support beam
8*d* Turning center shaft
8*e* Virtual circle
8*f* Axis
9 Guide wheel
10 Mounting shaft
11 First turn member
12 Second turn member
13 Linear guide
14 Restoration rod
15 Horizontal damper
16 First steering arm
17 Second steering arm

18 Tie rod
19 Connecting rod
20 Axle bracket
21 Support shaft
22 Link lever
22*a* Long hole
31 Restoration mechanism
32 Actuator
41 Leaf swing
42 Detecting means
43 Control means
A, F1 to F6, CF1 to CF3, S Arrow
$\alpha$1 to $\alpha$3 Slip angle
d1 to d6 Distance

The invention claimed is:

1. A track-guided vehicle wheel truck including a pair of running wheels respectively connected to both ends of a steering axle by a kingpin, a guide wheel guided along a guide which is provided on a running track, and a guide frame to which the guide wheel is mounted, wherein the guide frame can turn relative to the steering axle, comprising:

a tie rod being arranged along a vehicle width direction on a center side of a vehicle front and rear direction relative to the steering axle, and being capable of interlocking the pair of running wheels with each other;

a connecting rod being arranged on a vehicle end side of the vehicle front and rear direction relative to the steering axle, and being capable of steering one of the pair of running wheels;

a first steering arm arranged along the vehicle front and rear direction, and mounted to one of the kingpins of the pair of running wheels;

a second steering arm arranged along the vehicle front and rear direction, and mounted to the other of the kingpins of the pair of running wheels;

an axle bracket provided along the vehicle front and rear direction so as to straddle the steering axle in a center of the vehicle width direction of the steering axle;

a support shaft provided on the axle bracket such that position thereof can be adjusted in the vehicle front and rear direction so as to straddle the steering axle relative to the axle bracket; and a link lever arranged along the vehicle front and rear direction;

wherein both end parts of the tie rod are rotatably mounted respectively to center-side end parts of the first steering arm and the second steering arm;

wherein both end parts of the connecting rod are rotatably mounted respectively to a vehicle end-side end part of the first steering arm and a vehicle end-side end part of the link lever;

wherein an intermediate part of the link lever is rotatably mounted to the guide frame;

wherein a long hole is provided in a center-side end part of the link lever so as to extend in the vehicle front and rear direction; and wherein the long hole and the support shaft are rotatably engaged with each other at a given position.

2. A track-guided vehicle wheel truck according to claim 1, wherein a restoration mechanism capable of restoring the support shaft to an original position after moving the support shaft, is provided in the guide frame, and the support shaft is movable in the vehicle front and rear direction by an actuator provided in the steering axle.

3. A track-guided vehicle wheel truck according to claim 2, wherein the guide wheel is supported by a leaf spring provided in the guide frame, detecting means for detecting a displacement of the leaf spring, is provided, and control means for controlling the actuator corresponding to the displacement of the leaf spring detected by the detecting means, is provided.

4. A track-guided vehicle comprising the track-guided vehicle wheel truck according to claim 1.

* * * * *